US005601102A

United States Patent [19]

Rivette et al.

[11] Patent Number: 5,601,102

[45] Date of Patent: Feb. 11, 1997

[54] TOTE CLEANING SYSTEM

[75] Inventors: Stephen Rivette; Michael Doherty, both of Fenton; Charles Savage, St. Johns; Charles Jones, Gaines; Jeffrey Risinger, Grand Blanc, all of Mich.

[73] Assignee: Vinewood Corporation, Durand, Mich.

[21] Appl. No.: 556,306

[22] Filed: Nov. 13, 1995

[51] Int. Cl.[6] ..... B08B 3/02; B08B 9/14

[52] U.S. Cl. ..... 134/62; 134/79; 134/111; 134/133; 134/169 R

[58] Field of Search ..... 134/61, 62, 66, 134/72, 79, 83, 88, 89, 90, 91, 111, 133, 169 R

[56] References Cited

U.S. PATENT DOCUMENTS

| | | | |
|---|---|---|---|
| 1,475,535 | 11/1923 | Bonine et al. | 134/72 |
| 4,628,972 | 12/1986 | LaRochelle | 134/72 X |
| 5,371,911 | 12/1994 | Mullinax | 134/62 X |

*Primary Examiner*—Philip R. Coe
*Attorney, Agent, or Firm*—Gifford, Krass, Groh, Sprinkle, Patmore, Anderson & Citkowski, P.C.

[57] ABSTRACT

A system for cleaning totes is disclosed in which each tote has a fill opening at its top and a dispensing valve, both of which are open to an interior chamber of the tote. The system includes a conveyor line having a receiving end and a discharge end and which is adapted to transport the totes from the receiving and to the discharge end. At a first station along the conveyor, the tote is initially drained of any remaining fluid within its interior and the tote is then moved to a second station. At the second station, a wash solution is cycled through the tote in order to clean the interior of the tote. The wash solution is recycled and appropriate fillers are used to remove the impurities from the wash solution. The tote then progressively moves through three rinse stations along the conveyor line in which each rinse station includes a lid attachable to the fill opening of the tote and which progressively rinses the interior of the tote. Thereafter, a dry station forces heated and filtered air through the interior of the tote thus completely drying the entire interior of the tote. Thereafter, a cleaned lid for the tote is replaced onto the fill opening together with the cleaned valve assembly and the now clean tote exits from the discharge end of the conveyor line.

20 Claims, 2 Drawing Sheets

TOTE CLEANING SYSTEM

BACKGROUND OF THE INVENTION

1. Field of the Invention

The present invention relates to a system for cleaning totes.

2. Description of the Prior Art

Paint and other chemicals utilized by large OEM users, such as automotive manufacturers, are typically purchased by the user in totes. Although the totes may vary in size, a typical size for a tote is six feet tall by a four foot square. A fill opening at the top of the tote is provided for filling the tote with the liquid while a valve assembly, typically adjacent the bottom of the tote, is provided for removing the contents of the tote as desired by the end user.

Due to the high cost of the tote, once the liquid in the tote has been used, the tote is conventionally cleaned, refilled and then reused. In order to clean the interior of the tote, it has been the previous practice for workers to enter into the interior of the tote with scrub brushes and other cleaning equipment and then to manually scrub the interior of the tote. The tote is allowed to air dry and, when dry, recapped and then shipped to the appropriate filling station.

Many OEM users, for example the automotive industries, have increased the demand for cleanliness of the tote after the tote is cleaned and prior to refilling with paint or similar liquid. Such strict cleanliness specifications are required in order to prevent surface defects, such as fish eye, from forming on the vehicles when the vehicles are painted by the automotive OEM user. Indeed, it is not believed possible to meet cleanliness standards of the tote after cleaning for future requirement projections of the automotive industry while using the previously known methods for cleaning the totes.

SUMMARY OF THE PRESENT INVENTION

The present invention discloses a system for cleaning totes which overcomes all of the above-mentioned disadvantages of the previously known methods.

In brief, the system of the present invention comprises a conveyor line having a receiving end and a discharging end. The conveyor line is adapted to transport totes from the receiving end of the line and to the discharging end.

At a first station immediately adjacent the receiving end of the conveyor, the tote is initially drained of any remaining fluid contained within the interior of the tote. This removed fluid is then disposed of in any conventional fashion. Additionally, the tote lid is removed from the tote for cleaning.

Thereafter, the tote is moved along the conveyor line to a second station where a wash lid is secured to the tote. The wash lid includes a nozzle which is positioned within the interior of the tote and this nozzle is connected to a source of pressurized wash fluid. A wash return line or conduit is also connected from the tote valve to a wash reservoir or holding tank.

With the wash lid secured to the tote and the wash valve open, a pump at the wash station pumps a wash solution through a 35 micron filter into the interior of the tote and out through its supply valve. The wash solution is then pumped back into the holding tank and recycled by the wash station, filtered and returned to the interior of the tote for a predetermined period of time, for example three cycles of six minutes each. Furthermore, the wash station utilizes a highly pressurized and heated washing solution. A tilt mechanism is also used to tilt the tote to ensure complete cleaning of the tote following the wash cycle.

After the wash cycles have been completed, the tote is moved on the conveyor line to the next station which is the first rinse station. At the first rinse station, a first rinse lid is secured to the tote such that a rinse nozzle secured to the rinse lid is positioned within the interior of the tote. A pump at the first rinse station then cycles a rinse solution through the interior of the tote thus rinsing the wash solution as well as any debris from the interior of the tote. This rinse solution, furthermore, is recycled by the first rinse station while appropriate filters, such as a 25 micron filter, removes debris entrained within the rinse solution from the rinse solution.

The first rinse station is then followed by a second and third rinse station which are substantially identical to each other. In the second and third rinse station, heated and pressurized water is cycled through tile interior of the tote and then recycled back to a reservoir at its rinse station. Filters, such as a 10 micron filter, are utilized to remove any debris entrained within the rinse solution from the rinse solution.

After the first rinse station, the valve is removed from the tote and manually cleaned. Similarly, the previously removed tote lid is also cleaned manually of any debris or the like along with any tote accessories, such as an agitator.

After the third rinse station, the tote is then moved to a dry station on the conveyor line. At the dry station, a drying lid is secured to the tote fill opening. Pressurized, filtered and heated air is then cycled through the interior of the tote thus completely drying the interior of the rate. Thereafter, the now cleaned valve and original lid for the tote are installed onto the tote. Thereafter the outside of the tote is cleaned at a wipe down station. The tote is then removed from the discharge end of the conveyor line thus completing the cleaning operation for the tote.

The tote cleaning system of the present invention is thus able to remove virtually all impurities from the interior of the tote prior to refilling the tote with paint or the like.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
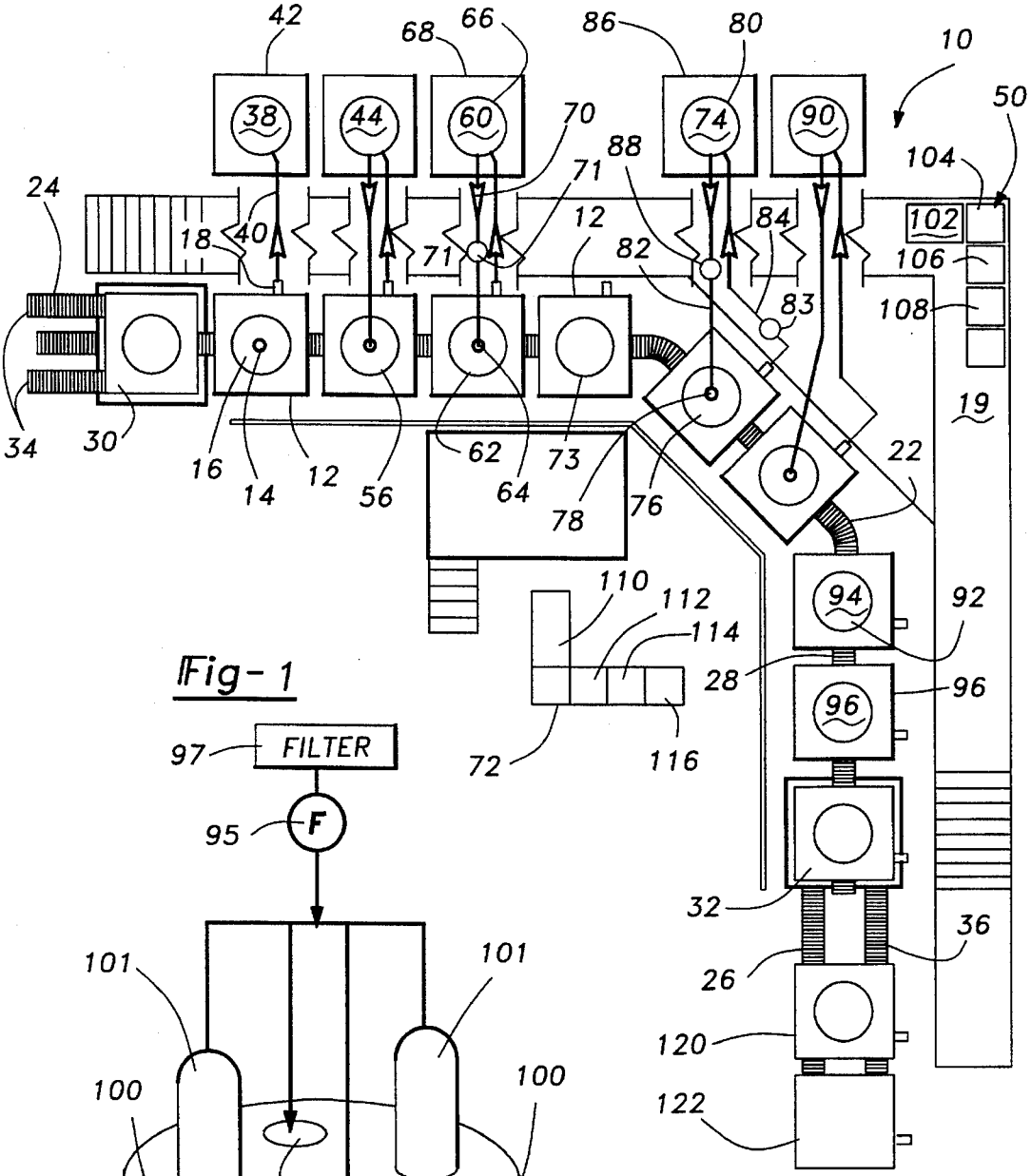
FIG. 1 is a diagrammatic view illustrating a preferred embodiment of the present invention.
Figure 2:
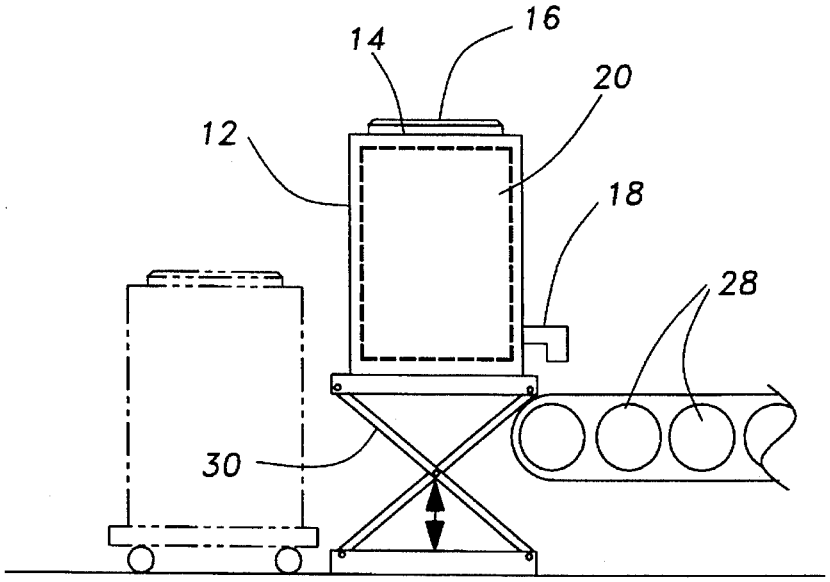
FIG. 2 is a fragmentary view illustrating the lift table.

With reference first to FIGS. 1 and 2, a top diagrammatic view of the tote cleaning system 10 of the present invention for cleaning a series of totes 12. Each tote 12 includes an upper fill opening 14 normally closed by a tote lid 16 as well as a valve assembly 18 for removing the contents from an interior chamber 20 of the tote 12.

As best shown in FIG. 1, the system 10 includes a generally L-shaped conveyor line 22 having a receiving end 24 and a discharge end 26. A plurality of conveyor rollers 28 are provided between the receiving end 24 and discharge end 26 of the conveyor 22 which engage the bottom of the totes 12 to transport the totes along the conveyor line 22. The rollers 28 are preferably not driven but, instead, the totes 12 are manually pushed along the conveyor line 22. Alternatively, of course, the conveyor rollers 28 may be power driven.

Figure 3:
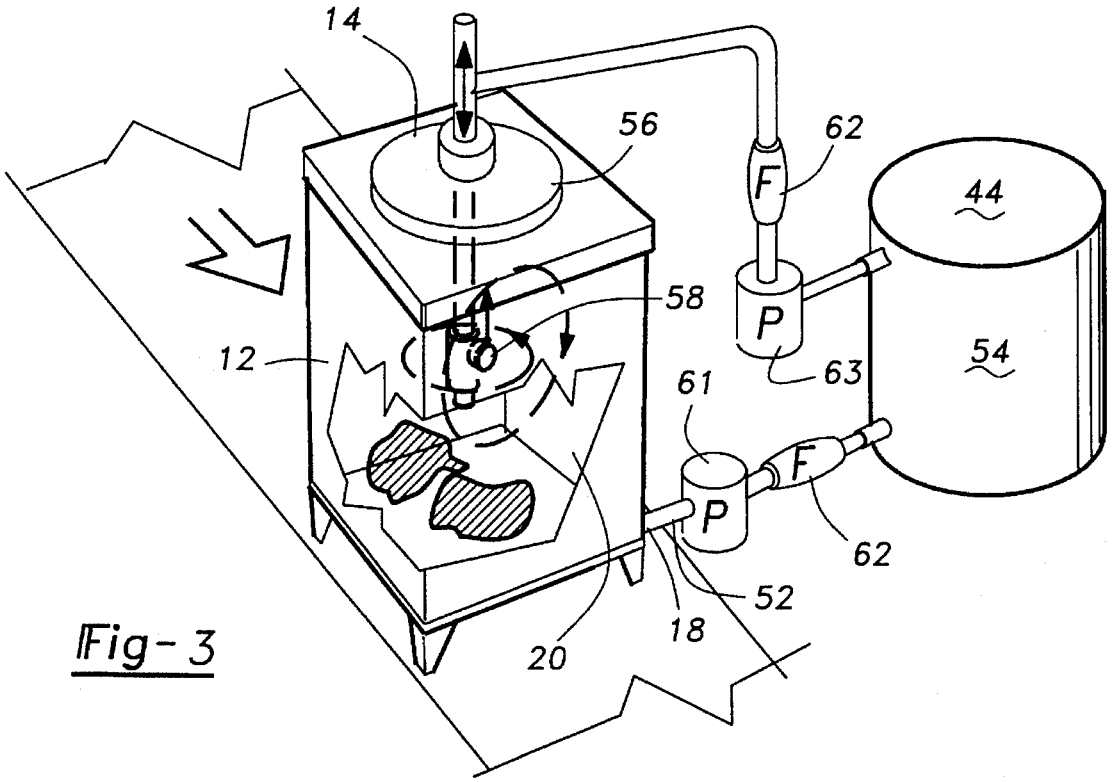
FIG. 3 is an elevational view of the wash station.

Preferably, the conveyor rollers 28 which form a part of the conveyor line are elevated several feet above the ground floor in order to provide greater accessibility for the workers to the valve assembly 18 while an elevated catwalk 19 along one side of the conveyor line 22 facilitates access to the top of the totes 12. Consequently, as shown in FIGS. 2 and 3, in order to move the totes 12 from the ground level to the conveyor rollers 28, a lift table 30 is provided at the receiving end 24 of the conveyor line 22. The lift table, when actuated, lifts the totes 12 from the receiving end (phantom line) and up onto the conveyor rollers 28 (solid line). Referring to FIG. 1, a second lift table 32 is provided adjacent the discharge end 26 of the conveyor line 22 for moving the totes down from the rollers 28 and to the discharge end 26 to the rollers 36 once the cleaning of the tote has been completed. Loading rollers 34 upstream from the first lift table 30, as well as unloading rollers 36 downstream from the second lift table 32 to facilitate the movement of the totes 12 onto the lift table 30 and off from the lift table 32.

Referring now to FIG. 2, after the tote 12 is elevated by the first lift table 30 onto the rollers 28, the tote 12 is manually moved or rolled to a drain station 38. Referring to FIG. 1, at the drain station, the valve assembly 18 for the tote 12 is connected to a fluid conduit 40 and the valve 18 is then opened. In doing so, any residual contents of the tote 12 are removed through the conduit 40 to a collection resevoir 42 at the drain station 38. The removed contents of the successive totes in the collection reservoir 42 are ultimately environmentally disposed of in any conventional way. At the drain station 38, the original tote lid 16 is removed and manually cleaned at a tote lid cleaning station 50 which will be subsequently described.

After the residual contents of the tote 12 has been removed at the drain station 38, the tote 12 is manually rolled to a wash station 44 immediately downstream from the drain station 38.

As best shown in FIG. 3, a hose 52 is connected between the tote valve 18 and a resevoir 54 at the wash station 44. A wash lid 56 having a nozzle system 58 having one or more nozzles is then connected to the fill opening 14 of the tote 12 such that the nozzle system 58 is contained within the interior tote chamber 20. Preferably, the nozzle system 58 is an indexing nozzle so that outflow from the nozzle(s) impinges all areas of the tote chamber 20.

A pump 63 at the wash station 44 then pumps the wash solution through the interior chamber 20 of the tote 12 and this wash solution is continually recycled from the reservoir 54 to the interior chamber 20 of the tote. Appropriate filters 62 are fluidly connected in series between the wash station resevoir 54 and the nozzle 58 within the interior 20 of the tote 12 as well as the conduit 52 in order to remove debris from the wash stream.

In the preferred embodiment, the pump 63 at the wash station 44 cycles the wash solution through the tote 12 at a high pressure, preferably 700 psi, and at an elevated temperature, preferably 140° F. The wash station 44 subjects the tote 12 to automated wash cycles of six minutes each and a pump 61 is used to pump the wash solution from the interior of the tote back to the wash resevoir 54. A tilt mechanism also tilts the tote 12 to ensure complete draining of the tote 12. The wash lid is then removed, the valve disconnected, and the tote is moved to a first rinse station 60 (FIG. 1) immediately downstream from the wash station 44.

With reference to FIGS. 1 and 3, the first rinse station 60 is similar in construction to the wash station 44. At the first rinse station 60, a rinse lid 62 is secured to the tote fill opening such that a rinse nozzle 64 is positioned within the interior of the tote 12. A pump 66 at the rinse station 60 pumps a rinse solution from a rinse resevoir 68 through a hose 70 through a filter vessel to the rinse nozzle 64. The rinse solution is then collected from the supply valve assembly 18 and returned to the rinse reservoir 68. Appropriate filters, such as a 25 micron filter 71 is connected in series with the hose 70.

Preferably, the first rinse station 60 utilizes water heated to approximately 120° F. Relatively low pressure, for example 55 psi, and flow rate of 60 gallons per minute is employed at the first rinse station 60 for rinsing the wash solution, together with any entrained debris, from the interior chamber 20 of the tote 12.

After the first rinse station 60 has completed its initial rinse of the tote, the rinse lid 62 is removed and the tote 12 is moved on the conveyor line to a valve and accessory, e.g. agitator, removal station 73. At the station 73, the valve assembly 18 is removed from the tote 12 and cleaned at a valve cleaning station 72 which will be subsequently described in greater detail. The agitator, if present, is also cleaned and any necessary agitator maintenance is performed. The tote 12 is then moved on the conveyor line to a second rinse station 74.

At the second rinse station 74 a second rinse lid 76 is secured to the tote fill opening 14. The second rinse lid 76 includes a nozzle(s) 78 positioned within the interior 20 of the tote 12 and this nozzle 78 is connected to a pump 80 by a hose 82. A second hose 84 is then connected to a collection trough positioned beneath the tote 12 which returns the second rinse solution to a second rinse reservoir 86 which is connected to a return pump. An appropriate filter, such as a 10 micron filter 88 is connected in series with the hose 82 as well as a filter 83 in the return hose 84.

The second rinse station 74 circulates clean deionized water through the tote 12 at a relatively high pressure, for example 300 psi and at a relatively high flow rate of 36 gallons per minute. Preferably, deionized water is used at the second rinse station 74 at a temperature of about 120° F. Consequently, the second rinse station rinses away any remaining debris from the interior 20 of the tote 12 and any such debris is removed by the filter system 88. The rinse solution at the second rinse station 74, like the first rinse station 60 and wash station 44, is continuously recycled throughout the tote 12 and reused. The filter system 88, as well as the solution within the reservoir 86 is removed, cleaned and/or discarded as required.

After the second rinse station 74 has completed the second rinse of the interior 20 of the tote 12, the second rinse lid 76 is removed and the tote 12 is moved along the conveyor line to a third rinse station 90. The third rinse station 90 is substantially the same as the second rinse station 74 so that a further description thereof is unnecessary. This third rinse station 90, however, is provided to ensure that any remaining debris within the interior of the tote is completely removed from the tote. The tote 12 is then moved to a dry station 94.

Figure 4:
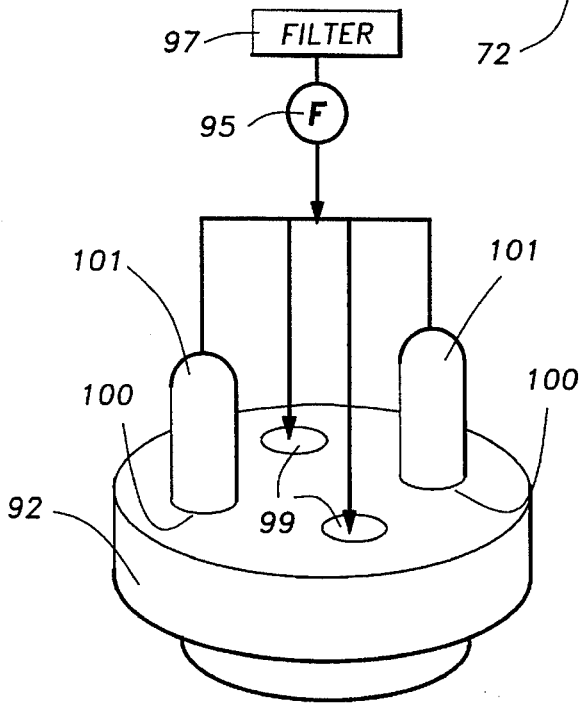
FIG. 4 is a side view of the drying lid.

With reference now to FIGS. 1 and 4, at the dry station 94, drying lid 92 (FIG. 4) is secured to the tote fill opening and an air pump 95 inducts air through a 0.03 micron filter 97 and pumps the inducted air through two ambient openings 99 and two heated openings 100 on the lid 92. Heaters 101 are provided in series with the openings 100 to heat the air flow through the openings 100. Preferably, a flow rate of 1500 cfm of air is pumped through the tote 12 for approximately twelve minutes. The drying lid 92 is then removed and the tote is moved along the conveyor line 22 to a reassembly station 96.

While the tote has undergone its rinsing operations, both the lid as well as the valve assembly have been removed from the tote 12. The lid is then cleaned at the lid cleaning station 50 which is preferably located on the catwalk 19 extending along the length of the conveyor line 22. The lid washing station 50 is conventional in construction and includes both a wash substation 102, sequential rinse substations 104, 106, 10 micron filters and a 0.03 filtered air/heat drying substation 108.

Similarly, the valve components are cleaned at the valve cleaning station 72 which, like the lid cleaning station 50, includes a wash substation 110 followed by sequential rinsing substations 112, 114, 10 micron filters and a 0.03 micron air heat drying substation 116.

At the reassembly station 96 following the drying station 94, the now cleaned lid 16 and valve components 18 are reassembled onto the tote 12 and the interior tote cleaning process is completed. The tote 12 is then moved to the second lift table 32 which lowers the tote from the conveyor rollers 28 down to the discharge rollers 36 at the discharge end 26 of the conveyor line 22.

The exterior surface of the tote is then manually cleaned at a wipe-down station 120 and labels are also cleaned and/or replaced as required. The tote 12 is then moved to an optional weigh station 122 where the tote is weighed and the tote cleaning process completed.

Preferably the conveyor line 22 is generally L-shaped as best shown in FIG. 1. Such construction enables a single supervisor to supervise the entire conveyor line from a position adjacent the valve cleaning station 72. Alternatively, a straight line conveyor can be used.

From the foregoing, it can be seen that the system of the present invention provides a novel and unique system for cleaning totes in preparation for refilling the totes with paint or the like. By utilizing the automated lids attachable to the tote fill opening together with the high pressure and temperatures employed by the various wash and rinse stations together with filtration at almost each station, highly effective cleaning of the tote is obtained. Furthermore, the present invention enhances worker efficiency and safety due to its improved ergonomics.

Having described my invention, however, many modifications thereto will become apparent to those skilled in the art to which it pertains without deviation from the spirit of the invention as defined by the scope of the appended claims.

We claim:

1. A system for cleaning totes, each tote having a fill opening and a dispensing valve, said fill opening and said valve being open to an interior chamber of said tote, said system comprising:

a conveyor line having a receiving end and a discharging end, said conveyor line adapted to transport totes from said receiving end to said discharging end, means adjacent said receiving end of said conveyor line for washing said tote by cycling a wash solution through said tote, said washing means having a wash lid secured to said fill opening, means downstream from said washing means for rinsing the interior chamber of the tote, said rinsing means having a rinse lid attachable to said fill opening, means downstream from said rinsing means for drying the interior chamber of the tote, said drying means having a drying lid attachable to said fill opening.

2. The invention as defined in claim 1 wherein said conveyor line comprises a plurality of adjacent rollers which engage and support a bottom surface of each tote, said rollers being elevated above a ground support surface, and means at said receiving end of said conveyor line for raising said totes from the ground support surface to said rollers.

3. The invention as defined in claim 2 and comprising means at said discharge end of said conveyor line for lowering said totes from said rollers to the ground support surface.

4. The invention as defined in claim 1 and comprising means connectable to said valve means upstream from said washing means for draining liquid from the interior chamber of the tote.

5. The invention as defined in claim 1 wherein said washing means comprises at least one nozzle secured to said wash lid, said at least one nozzle being positioned within the tote when said first lid is secured to the refill opening, means for pumping said wash solution through said at least one nozzle at a preselected temperature and pressure.

6. The invention as defined in claim 5 wherein said preselected pressure is in excess of 500 psi and said temperature is in excess of 100° F.

7. The invention as defined in claim 6 wherein said preselected pressure is substantially 700 psi and said temperature is substantially 140° F.

8. The invention as defined in claim 5 wherein said washing means comprises at least one filter and means for recycling the wash solution through said filter and the interior chamber of the tote.

9. The invention as defined in claim 1 wherein said rinsing means comprises a first rinse station and a second rinse station, each rinse station comprising at least one filter and means for recycling water through said filter and the interior chamber of the tote.

10. The invention as defined in claim 9 wherein the filter at the second rinse station has a smaller mesh size than the filter of the first rinse station.

11. The invention as defined in claim 10 wherein said filter at said first station has a mesh size of 25 microns and said filter at said second station has a mesh size of 10 microns.

12. The invention as defined in claim 9 wherein said first rinse station recycles water through the interior chamber of the tote at a first pressure and said second rinse station recycles water through the interior chamber of the tote at a second pressure, said second pressure being higher than said first pressure.

13. The invention as defined in claim 12 wherein said second pressure is in excess of 200 psi.

14. The invention as defined in claim 13 wherein said second pressure is substantially 300 psi.

15. The invention as defined in claim 9 wherein said second station uses deionized water to rinse the tote.

16. The invention as defined in claim 9 and comprising a third rinse station downstream from said second rinse station, said third rinse station being substantially identical to said second rinse station.

17. The invention as defined in claim 1 wherein said drying means comprises means attached to said drying lid for flowing heated air through the tote.

18. The invention as defined in claim 17 wherein said heated air flowing means comprises a heater attached to said drying lid.

19. The invention as defined in claim 17 wherein said drying means comprises means for flowing room temperature air through the tote simultaneously with said heated air.

20. The invention as defined in claim 1 wherein said conveyor line is generally L-shaped.

* * * * *